US009194258B2

(12) United States Patent
Durocher et al.

(10) Patent No.: US 9,194,258 B2
(45) Date of Patent: Nov. 24, 2015

(54) GAS TURBINE ENGINE CASE BOSSES

(75) Inventors: Eric Durocher, Vercheres (CA); Guy Lefebvre, Saint-Bruno (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 942 days.

(21) Appl. No.: 13/405,669

(22) Filed: Feb. 27, 2012

(65) Prior Publication Data

US 2013/0224012 A1 Aug. 29, 2013

(51) Int. Cl.
*F01D 25/28* (2006.01)

(52) U.S. Cl.
CPC ..... *F01D 25/28* (2013.01); *F05D 2230/232* (2013.01); *F05D 2230/237* (2013.01); *F05D 2230/54* (2013.01); *Y10T 29/49229* (2015.01)

(58) Field of Classification Search
CPC ..... F01D 25/28; F05D 2230/54
See application file for complete search history.

(56) References Cited

U.S. PATENT DOCUMENTS

| | | | | |
|---|---|---|---|---|
| 2,373,405 | A | | 4/1945 | Lowit |
| 3,499,066 | A | | 3/1970 | Murray |
| 3,823,463 | A | | 7/1974 | Weaver et al. |
| 4,441,323 | A | * | 4/1984 | Colley ..... 60/737 |
| 4,595,556 | A | | 6/1986 | Umeha et al. |
| 4,687,185 | A | | 8/1987 | Urano et al. |
| 4,729,789 | A | | 3/1988 | Ide et al. |
| 5,013,611 | A | | 5/1991 | Suzuki et al. |
| 5,230,212 | A | * | 7/1993 | Forestier ..... 60/39.23 |
| 5,273,710 | A | | 12/1993 | Zengin |
| 5,482,671 | A | | 1/1996 | Weber |
| 5,710,969 | A | | 1/1998 | Newman |
| 6,355,211 | B1 | | 3/2002 | Huang |
| 6,488,887 | B1 | | 12/2002 | Arai et al. |
| 7,347,968 | B2 | | 3/2008 | Lim et al. |
| 7,713,467 | B2 | | 5/2010 | Becker et al. |
| 2009/0196761 | A1 | | 8/2009 | James |
| 2010/0104465 | A1 | | 4/2010 | Simpson et al. |
| 2010/0200189 | A1 | | 8/2010 | Qi et al. |
| 2011/0033331 | A1 | | 2/2011 | Tuppen et al. |

* cited by examiner

*Primary Examiner* — Edward Look
*Assistant Examiner* — Jason Davis
(74) *Attorney, Agent, or Firm* — Norton Rose Fulbright Canada LLP

(57) ABSTRACT

A gas turbine engine case has a metallic composite boss mounted thereto. The boss may have a main metal injection molded (MIM) part, and a separately formed flange part integrated to the main MIM part and projecting laterally outwardly therefrom. The MIM part and the flange part may be made of different materials. The material of the flange part is selected to provide a suitable mounting interface with the gas turbine engine case.

18 Claims, 4 Drawing Sheets

GAS TURBINE ENGINE CASE BOSSES

TECHNICAL FIELD

The application relates generally to gas turbine engines and, more particularly, to engine cases with bosses.

BACKGROUND OF THE ART

Gas turbine engine cases are typically provided on the outer side thereof with bosses or similar service or mounting pads. The bosses are generally machined from solid directly on the case or separately produced as single cast parts which are then welded to the case. The machining of bosses on the case is time consuming and thus expensive. The choice of cast materials that can be used for separately fabricated bosses is limited by the need of welding the bosses to the engine case. Also for weld joint architectures, cast materials may not always be ideal from a durability point of view. There is also a need for reducing the overall weight of gas turbine engine casings.

SUMMARY

In one aspect, there is provided a gas turbine engine case comprising an annular shell, at least one aperture defined through a wall of the annular shell; and at least one boss mounted to said annular shell in alignment with said at least one aperture and projecting outwardly from said annular shell; said at least one boss comprising: a metal injection molded (MIM) part and a separate flange part projecting integrally outwardly from said MIM part, the MIM part and the flange part being made from different materials, said flange part having an inner portion imbedded in said MIM part and a peripheral outer portion fixedly joined to said annular shell.

In a second aspect, there is provided a metallic composite boss of a gas turbine engine case, comprising a main metal injection molded (MIM) part, and a separately formed flange part integrated to the main MIM part and projecting laterally outwardly therefrom, the main MIM part and the flange part being made of different materials, the material of the flange part being selected to provide a suitable mounting interface with the gas turbine engine case.

In a third aspect, there is provided a method of manufacturing a gas turbine engine case, the method comprising: obtaining an annular shell with at least one aperture defined through a wall of the shell, metal injection molding a boss about a central portion of a sheet metal flange to provide a composite metallic boss member, positioning the composite metallic boss member on the shell in alignment with the at least one aperture, and fixedly joining the sheet metal flange of the composite metallic boss member to the shell.

DESCRIPTION OF THE DRAWINGS

Reference is now made to the accompanying figures, in which.

DETAILED DESCRIPTION OF THE PREFERRED EMBODIMENTS

Figure 1:
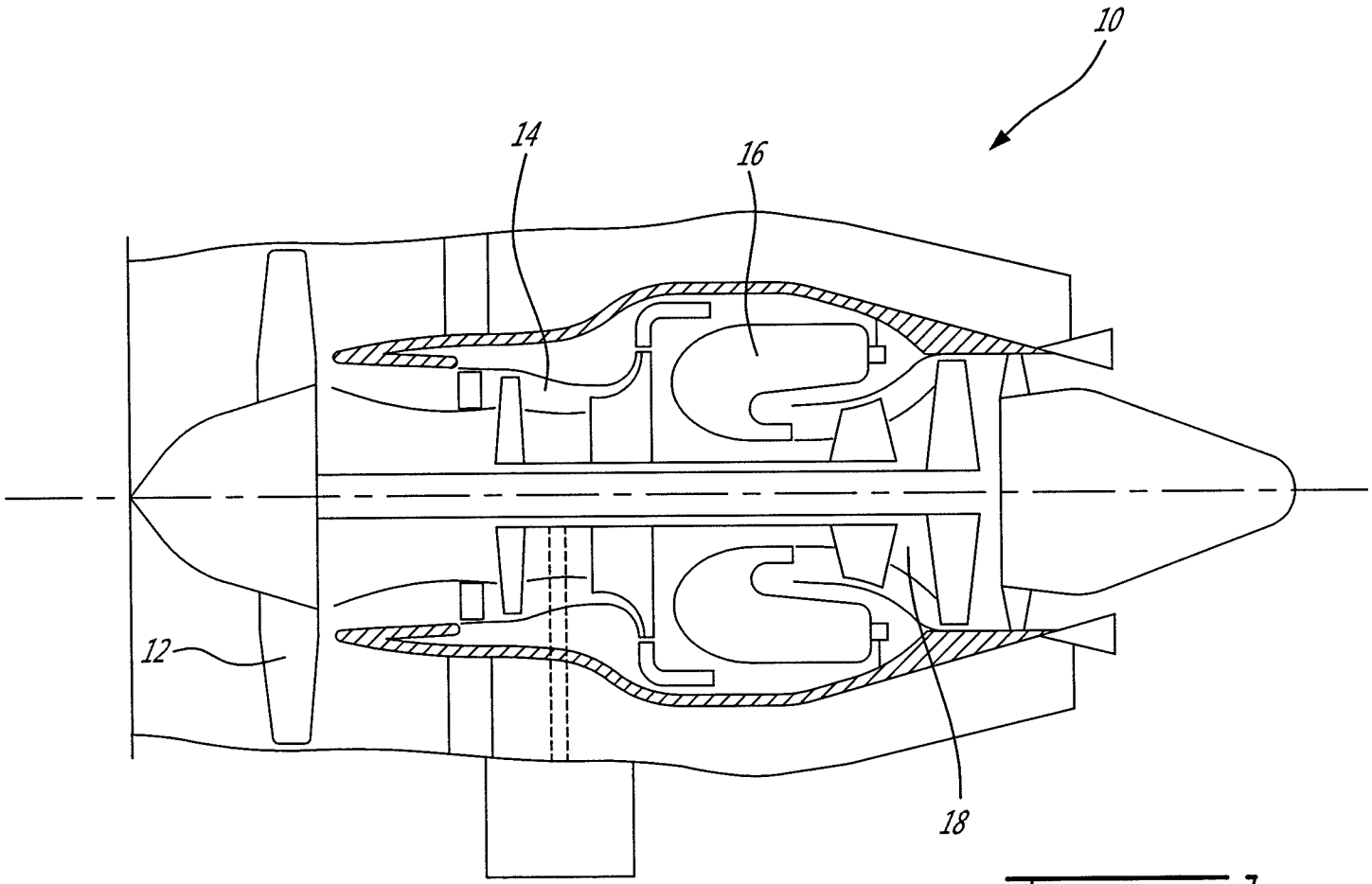
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
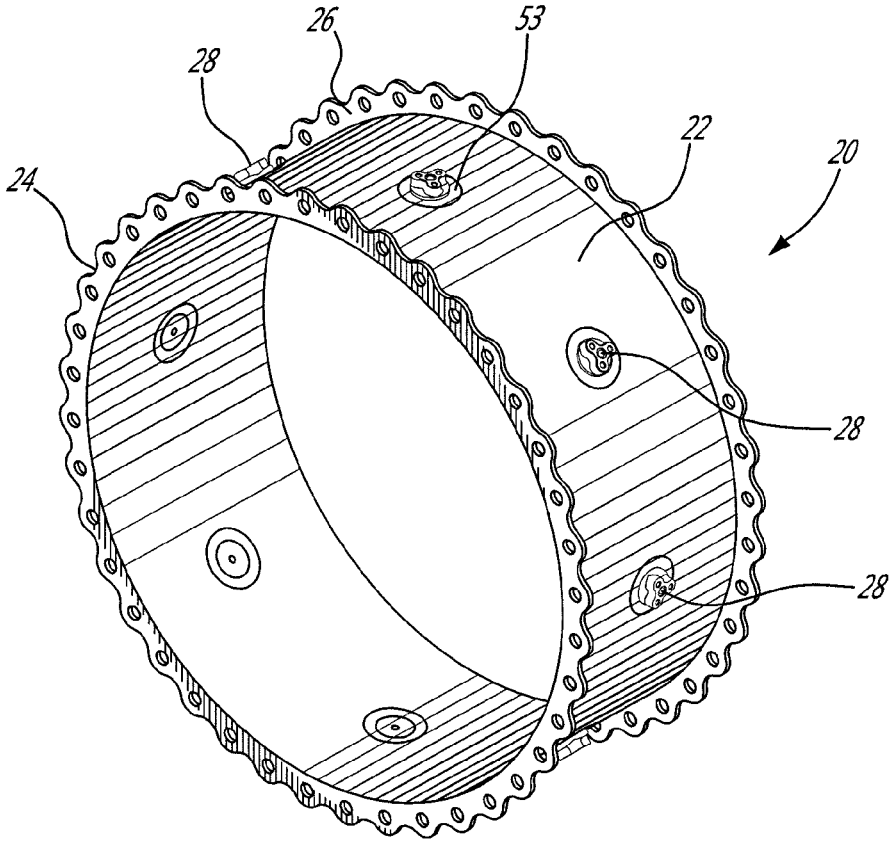
FIG. 2 is an isometric view of a case of the gas turbine engine, the case having a plurality of circumferentially spaced-apart bosses provided thereon.

The engine 10 typically comprises a segmented case assembly. For instance, the engine may comprise a fan case (not shown), an intermediate case (not shown), compressor case (not shown), a gas generator case (not shown), a turbine case (not shown) and a turbine exhaust case (not shown) axially interconnected about the centerline of the engine 10. FIG. 2 illustrates an engine case 20 which may be used to form one segment (e.g. the turbine case) of the engine case assembly.

Figure 7A:
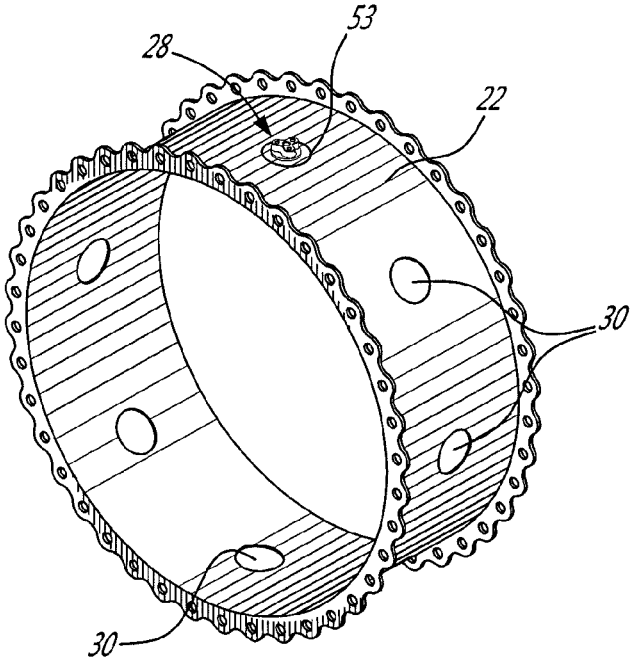
FIG. 7 illustrates the mounting of the MIM boss to the shell of the engine case.
Figure 7B:
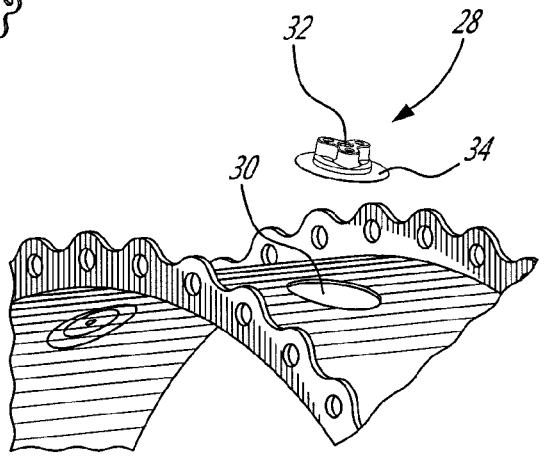

The engine case 20 comprises an annular or cylindrical shell 22 extending axially between a front mounting flange 24 and a rear mounting flange 26. According to one possible application where the engine case 20 surrounds a hot section of the engine, the shell 22 and the flanges 24 and 26 may be made of nickel alloys or other materials having suitable thermal resistance properties. In cold sections of the engine (e.g. fan and compressor section), the shell could be made of other materials; such as Aluminium. Depending on the applications, the shell 22 may be made from sheet metal in order to minimize the weight of the engine. One or more sheet metal parts may be rolled and welded to create a cylinder. The front and rear flanges 24 and 26 may then be welded to the opposed ends of the cylinder to complete the assembly of the shell 22. Circumferentially spaced-apart bosses 28 may be provided on the shell 22 of the engine 10. The bosses 28 project outwardly from the radially outer surface of the shell 22. The bosses 28 may be used for various applications, including air/oil line connections, mounting equipment such as thermocouples and sensors, and providing access for boroscopes. This is not intended to constitute an exhaustive list of all possible applications. As shown in FIG. 7, circumferentially spaced-apart apertures 30 may be defined in the skin of the shell 22 for allowing the mounting of the bosses 28 to the shell 22.

FIGS. 3 to 6 illustrate the manufacturing process of the bosses 28. Each boss 28 may have a composite construction including two integrated parts made of different materials, a first material which is best suited for the intended application and a second material which is best suited for creating a proper interface with the shell 22 of the engine case 20. For instance, the boss 28 may comprise: 1) a main metal injection molded (MIM) boss part 32 and 2) a sheet metal interface or flange part 34. As will be seen hereinafter, the flange part 34 is used to form a flange or rim about the main MIM part 32, which flange may be used as a mounting interface for joining the boss 28 to the shell 22 of the engine case 20. In this way, the material for the MIM part 32 may be selected irrespectively of the material used for the shell 22 of the engine case 20.

Figure 3:
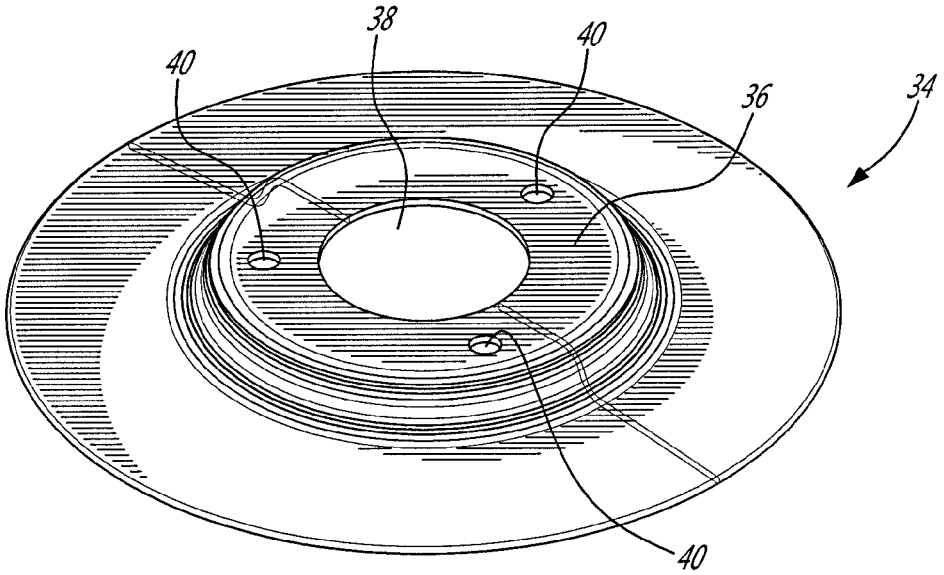
FIG. 3 is an isometric view of a sheet metal washer used to form a sheet metal flange or rim on each of the bosses.

As shown in FIG. 3, the flange part 34 is first produced. The flange part 34 may be provided in the form of a sheet metal washer which may be stamped or press formed against a die to have a central circular embossment or inner raised portion 36. A central hole or passage 38 may be defined in the embossment 36. Anchoring holes 40 may also be defined in the embossment 36 to ensure proper connection between the MIM material on top and below the flange part 34 and, thus, prevent relative rotation between the MIM part 32 and the flange part 34 in the integrated/unified boss component. The material of the flange part 34 may be selected to be compatible with the material of the shell 22. Typically, the material of the flange part 34 is selected to match that of the shell 22 of the engine case 20. For instance, the shell 22 and part 34 could be both made of a same Nickel alloy. According to one embodiment, the shell 22 and the sheet metal part 34 are made from a same sheet metal material having a thickness of less than about 0.035 inches. Such an arrangement, allows minimizing the weight of the overall engine case as compared to conventional engine case having cast bosses provided thereon. The materials of the sheet metal part 34 and of the shell 22 may be selected for weld ability, brazeability or other assembly considerations (e.g. avoid risk of corrosion if none compatible materials are associated to one another).

As an design option, the entire boss 28 could be produced in MIM process where flange part 34 is integrated with MIM part 32 but it depends on the required wall thickness for the flange part 34 (minimum thickness required for MIM process) and material compatibility with the engine case.

Figure 4:
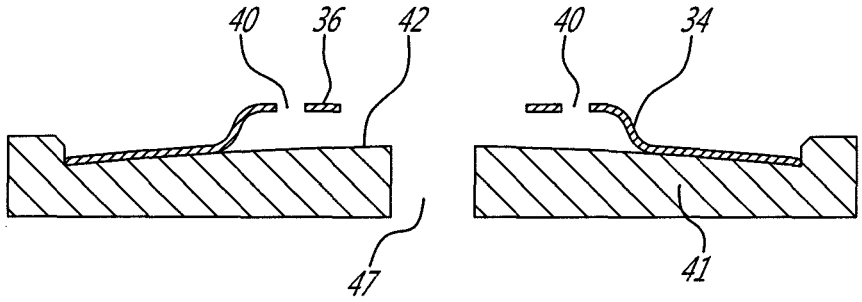
FIG. 4 is a schematic view of the sheet metal washer positioned in a lower mold detail of a metal injection mold.

As shown in FIG. 4, the so formed flange part 34 is positioned in a lower mold detail 41 of an injection mold. The peripheral rim portion of the flange part 34 surrounding the central embossment 36 is seated against the inner surface 42 of the lower mold detail 41. As can be appreciated from FIG. 4, the undersurface of the embossment 36 is spaced from the inner surface 42, thereby allowing MIM feedstock to be injected in the mold cavity on both sides of the central embossment 36 of the flange part 34. The embossment 36 provides a recess on the underside of the flange part 34, which recess will be filled with the MIM material, thereby providing for a generally flat and uniform undersurface in the resulting boss component. In this way, when mounted in the aperture 30 of the shell 22, the boss 28 inner surface may be substantially continuous and flush with the inner surface of the engine case 20, thereby avoiding the presence of any steps, inner protuberances or recesses that could negatively affect the flow of fluid passing through the engine case 20. The bottom configuration of the bosses 28 provides for an even and smooth flow boundary surface at the inner diameter of the engine case 20.

Figure 5:
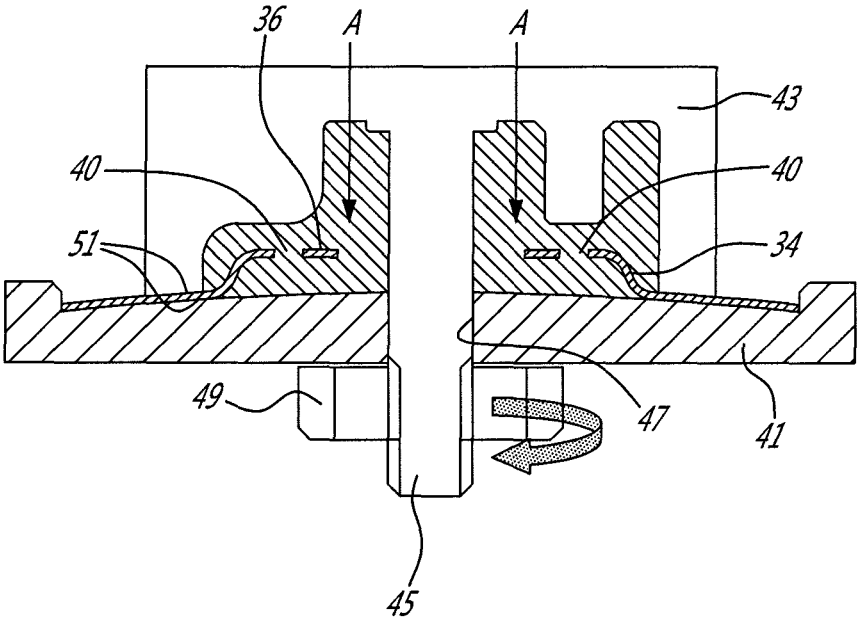
FIG. 5 is a schematic view illustrating the installation of the upper mold detail over the lower mold detail shown in FIG. 4 and the injection of metal injection molding (MIM) feedstock in the mold cavity.

As shown in FIG. 5, the upper mold detail 43 is then installed over the lower mold detail 41 and secured in position with appropriate means. For instance, the upper mold detail 43 may be provided on an inner surface thereof with a central stem portion 45 extending through a corresponding central bore 47 defined in the lower mold detail 41 and a nut 49 may be threadably engaged on a threaded distal end portion of the stem portion 45 for securely clamping the two mold details 41 and 43 together with the flange part 34 therebetween. O-rings 51 or other suitable sealing devices may be provided to avoid leakage during the metal injection. It can be appreciated that the peripheral portion of the flange part 34 extends outwardly from the mold cavity. This will result in the flange part 34 projecting outwardly from the MIM part 32 in the finished product.

Figure 6:
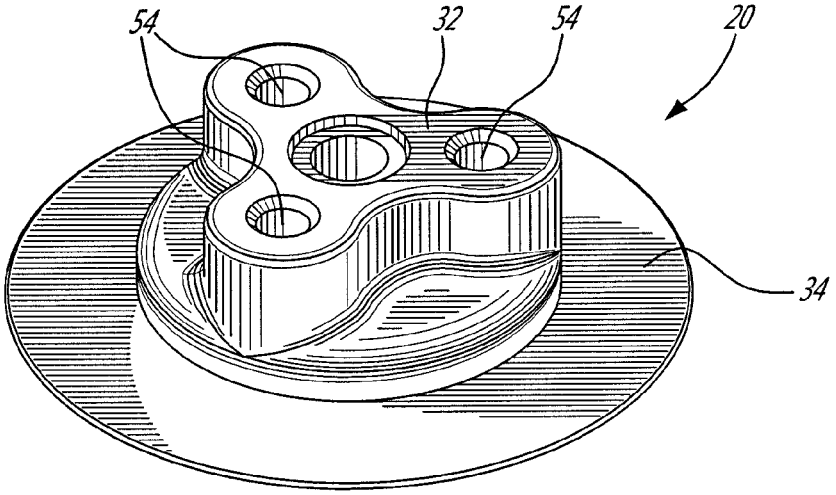
FIG. 6 is an isometric view of a resulting MIM boss with an integrated sheet metal flange.

Once the mold has been properly assembled with the flange part 34 therein, a suitable MIM feedstock comprising a mixture of metal powder and a binder is injected into the mold to fill the mold cavity about the central embossment 36 of the flange part 34 as schematically depicted by the two arrows A in FIG. 6. A softer metallic material (e.g. steel) than that of the flange part 34 may be selected for the MIM feedstock to facilitate any subsequent machining of the MIM part 32. With a softer metallic material the feed rate of the machining tool can be increased and, thus, machining time and costs can be reduced.

The resulting "green" boss with the integrated or imbedded flange part is cooled down and de-molded from the mold. As shown in FIG. 6, service or mounting holes 54 could be produced during molding of the MIM part 32. The holes 54 may be in a semi-finished or a finished condition. Alternatively, the holes 54 could be entirely machined at the final stage after the bosses 28 have been installed on the engine case 20. The holes 54 may be threaded for allowing threaded connection with equipment to be mounted to the engine case. The central hole 54 may be a through hole aligned with hole 38 of the flange part, to provide access to the interior of the engine case when installed thereon.

Next, the green boss is debinded using solvent, thermal furnaces, catalytic process, a combination of these know methods or any other suitable methods. The resulting debinded part (commonly referred to as the "brown" part) is then sintered in a sintering furnace. The sintering temperature of the various metal powders is well-known in the art and can be determined by an artisan familiar with the powder metallurgy concept.

Thereafter, the resulting sintered bosses may be subjected to any appropriate metal conditioning or finishing treatments.

The metallic composite bosses 28 may then be mounted to the shell 22 of the engine case 20 as shown in FIG. 7. The flange part 34 forms a mounting flange around the inner end of each boss 28. This mounting flange is sized to fit into the apertures 30 defined in the shell 22. The diameter of the flange of the boss 28 generally corresponds to the diameter of the aperture 30. The flange of the bosses 28 may be welded or brazed along the peripheral edge portion thereof to the shell 22. According to one embodiment, weld joint 53 (FIGS. 2 and 7) is provided along the full circumference of the bounding edge of each aperture 30. It is noted that for weld joint architecture, a sheet metal flange provides better mechanical properties than materials made from casting, thereby contributing to increase part life/durability at the weld joint areas.

After all the metallic composite bosses 28 have been joined to the shell 22 of the engine case 20, the bosses 28 may be subjected to a final machining step.

The above description is meant to be exemplary only, and one skilled in the art will recognize that changes may be made to the embodiments described without departing from the scope of the invention disclosed. For example, it is understood that any desired number of service bosses may be mounted to shell of the engine case. It is also understood that a wide variety of means may be used to join the bosses to the shell of the engine case. Still other modifications which fall within the scope of the present invention will be apparent to those skilled in the art, in light of a review of this disclosure, and such modifications are intended to fall within the appended claims.

What is claimed is:

1. A gas turbine engine case comprising an annular shell, at least one aperture defined through a wall of the annular shell; and at least one boss mounted to said annular shell in alignment with said at least one aperture and projecting outwardly from said annular shell; said at least one boss comprising: a metal injection molded (MIM) part and a separate flange part projecting integrally outwardly from said MIM part, the MIM part and the flange part being made from different materials, said flange part having an inner portion imbedded in said MIM part and a peripheral outer portion fixedly joined to said annular shell.

2. The gas turbine engine case defined in claim 1, wherein anchoring holes are defined in said inner portion of the flange part, said MIM part extending through said anchoring holes.

3. The gas turbine engine case defined in claim 1, wherein the flange part is sized to fit within said at least one aperture, and wherein a weld or brazed joint is provided between the peripheral outer portion of the flange part and a bounding edge portion of the at least one aperture.

4. The gas turbine engine case defined in claim 1, wherein the MIM part is made out of a softer metallic material than the flange part.

5. The gas turbine engine case defined in claim 4, wherein the annular shell and the flange part are made out of weldable or brazable compatible materials.

6. The gas turbine engine case defined in claim 5, wherein the annular shell has a sheet metal skin, and wherein the flange part of the boss is made out of a sheet metal material.

7. The gas turbine engine case defined in claim 1, wherein the flange part is provided in the form of a washer having a central hole which is aligned with a bore extending through the MIM part.

8. A metallic composite boss of a gas turbine engine case, comprising a main metal injection molded (MIM) part, and a separately formed flange part integrated to the main MIM part and projecting laterally outwardly therefrom, the main MIM part and the flange part being made of different materials, the material of the flange part being selected to provide a suitable mounting interface with the gas turbine engine case.

9. The metallic composite boss defined in claim 8, wherein the flange part is a sheet metal part.

10. The metallic composite boss defined in claim 8, wherein said flange part has a central portion which is imbedded in said MIM part, and wherein holes are defined through said central portion.

11. The metallic composite boss defined in claim 8, wherein the flange part is weldable or brazeable to the gas turbine engine case.

12. The metallic composite boss defined in claim 8, wherein the MIM part is made out of a softer metallic material than the flange part.

13. A method of manufacturing a gas turbine engine case, the method comprising: obtaining an annular shell with at least one aperture defined through a wall of the shell, metal injection molding a boss about a central portion of a sheet metal flange to provide a composite metallic boss member, positioning the composite metallic boss member on the shell in alignment with the at least one aperture, and fixedly joining the sheet metal flange of the composite metallic boss member to the shell.

14. The method defined in claim 13, wherein fixedly joining the sheet metal flange to the shell comprises welding or brazing the sheet metal flange to the shell.

15. The method defined in claim 13, comprising creating an embossment in the sheet metal flange prior to the metal injection molding step.

16. The method defined in claim 13, comprising defining holes in the central portion of the sheet metal flange prior to the metal injection molding step.

17. The method of claim 13, wherein metal injection molding comprises creating holes in the boss.

18. The method of claim 17, comprising finish machining said holes in the composite metallic boss after the composite metallic boss has been fixedly joined to the shell.

* * * * *